US008978683B1

(12) United States Patent
Boonstra

(10) Patent No.: US 8,978,683 B1
(45) Date of Patent: Mar. 17, 2015

(54) METHOD OF REDUCING DOWNWARD FLOW OF AIR CURRENTS ON THE LEE SIDE OF EXTERIOR STRUCTURES

(71) Applicant: Zeeland Wood Turning Works, Inc., Zeeland, MI (US)

(72) Inventor: Keith Erwin Boonstra, Holland, MI (US)

(73) Assignee: Zeeland Wood Turning Works, Inc., Zeeland, MI (US)

( * ) Notice: Subject to any disclaimer, the term of this patent is extended or adjusted under 35 U.S.C. 154(b) by 164 days.

(21) Appl. No.: 13/647,125

(22) Filed: Oct. 8, 2012

Related U.S. Application Data

(60) Provisional application No. 61/544,064, filed on Oct. 6, 2011.

(51) Int. Cl.
*F17D 1/16* (2006.01)

(52) U.S. Cl.
USPC ..... 137/13; 454/901; 516/114

(58) Field of Classification Search
CPC ..... E01H 13/00
USPC ..... 137/13, 14, 357, 360, 803, 807, 834; 239/14.1; 422/900; 454/188, 901; 516/114; 52/169.1, 900; 60/694
See application file for complete search history.

(56) References Cited

U.S. PATENT DOCUMENTS

| | | | | |
|---|---|---|---|---|
| 3,731,459 | A * | 5/1973 | Foster | 95/92 |
| 3,741,480 | A * | 6/1973 | Van Huisen | 239/14.1 |
| 3,974,756 | A * | 8/1976 | Long | 454/1 |
| 4,936,198 | A * | 6/1990 | de Mendoza Sans | 454/370 |
| 6,095,918 | A * | 8/2000 | Arroyo et al. | 454/188 |
| 2008/0257977 | A1 * | 10/2008 | Chan et al. | 239/14.1 |

OTHER PUBLICATIONS

Coxworth, Ben. "Sequestering smokestack carbon into cash". Jun. 10, 2010. http://www.gizmag.com/sequestering-smokestack-carbon-into-cash/15379/.*

* cited by examiner

*Primary Examiner* — John K Fristoe, Jr.
*Assistant Examiner* — R. K. Arundale
(74) *Attorney, Agent, or Firm* — Price Heneveld LLP

(57) ABSTRACT

A method of reducing the downward flow of air currents on the leeward side of an emissions emitting structure including the step of using a system that includes components chosen from the group consisting of one or more mechanical air moving devices; physical structures; and combinations thereof to create an increase in the air pressure within a volume of air on the leeward side of an emissions emitting structure having emissions that become airborne. The increased air pressure prevents or lessens downward flow of emissions that would occur without the use of the system and increases the safety by which one can travel a road or other transportation route that might otherwise be visually obscured by the emissions and the safety of the property and those within the area where emissions occur.

20 Claims, 3 Drawing Sheets

METHOD OF REDUCING DOWNWARD FLOW OF AIR CURRENTS ON THE LEE SIDE OF EXTERIOR STRUCTURES

CROSS-REFERENCE TO RELATED APPLICATION

This application claims priority to U.S. Provisional Patent Application Ser. No. 61/544,064, filed on Oct. 6, 2011, entitled METHOD OF REDUCING DOWNWARD FLOW OF AIR CURRENTS ON THE LEE SIDE OF EXTERIOR STRUCTURES, the entire disclosure of which is hereby incorporated by reference in its entirety.

BACKGROUND OF THE INVENTION

As shown in FIGS. 1-2, emissions emitting building structures 2, typically industrial factories or utility generating structures, often utilize an emission tower or towers, such as a steam tower (steam emitting cooling tower), cooling tower, or smokestack. The emission tower is typically located on a roof 6 or other elevated surface of the emissions emitting structure. When directional winds/air currents 8 flow past an exterior structure, such as an emission emitting structure (steam) tower containing facility, toward neighboring properties including roads 10, the base structure itself can cause or contribute to emissions such as generated steam or smoke to be drawn downward on the leeward side 12 of the structure 2. As a consequence, rather than being carried up into the atmosphere, these emissions 14 may then flow at very low altitudes across and/or along the contours of the land for some distance on the leeward side 12 of the building structure 2. This reduces visibility on such neighboring properties and/or causes other undesired negative effects. Some undesired effects include causing dangerously unsafe driving conditions by reducing visibilities along affected stretches of roadways (see FIG. 1, for example). This effect is more problematic when the road proximate the emission emitting structures is at an altitude higher than the altitude of the base of the emissions emitting structure as shown in FIG. 1.

SUMMARY OF THE INVENTION

An embodiment of the present disclosure is directed to a method of reducing the downward flow of air currents on the leeward side of an emissions emitting structure comprising the step of using a system that includes components chosen from the group consisting of one or more mechanical air moving devices; physical structures; and combinations thereof to create an increase in the air pressure within a volume of air on the leeward side of an emissions emitting structure having emissions that become airborne. The increased air pressure prevents or lessens downward flow of emissions that would occur without the use of the system.

Yet another aspect of the present disclosure is directed to a method of reducing the downward flow of air currents on the leeward side of an emissions emitting structure comprising the steps of (1) installing components outside and proximate the emissions emitting structure wherein the components are chosen from the group consisting of one or more industrial fans; one or more vertically or substantially vertically oriented walls that are at least 20% of the height of a tallest exterior wall on the leeward side of the emissions emitting structure; and (2) creating an increase in the air pressure within a volume of air proximate and along the leeward side of an emissions emitting structure using the components to cause at least two airflows to meet one another and create the increase in the air pressure that reduces the downward flow of air currents on the leeward side of the emissions emitting structure.

Another aspect of the present disclosure is generally directed to a method of reducing the downward flow of air currents on the leeward side of an emissions generating building and preventing emissions from lessening or blocking the visibility of a motorist traveling a road near the building comprising the step of: creating an increased air pressure zone proximate the leeward side of the building by using at least one airflow creating system that includes components chosen from the group consisting of two or more mechanical air moving devices; physical airflow directing structures; and combinations thereof to create at least two airflows that meet proximate, more typically along, the leeward side of the emission generating building and increase the air pressure within the zone of air on the leeward side of an emissions generating building chosen from the group consisting of a factory having emissions that become airborne, a power plant having emissions that become airborne, and an industrial or commercial facility having emissions that become airborne; wherein the increased air pressure zone prevents or lessens downward flow of emissions that would occur without the use of the system and presents the emissions from lessening or blocking the visibility of the motorist traveling the road.

DETAILED DESCRIPTION OF THE PREFERRED EMBODIMENTS

Figure 1:
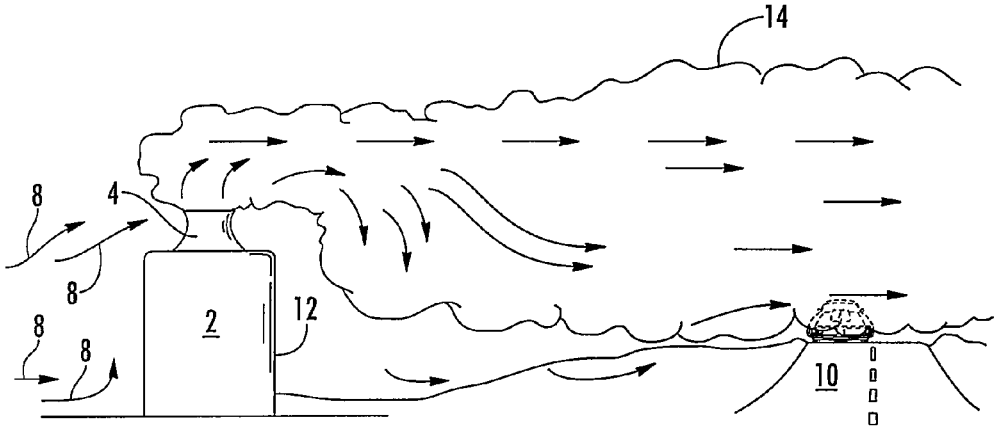
FIG. 1 is a side schematic view showing the current problems and general conditions around an emissions (steam) tower containing facility near a roadway.
Figure 2:
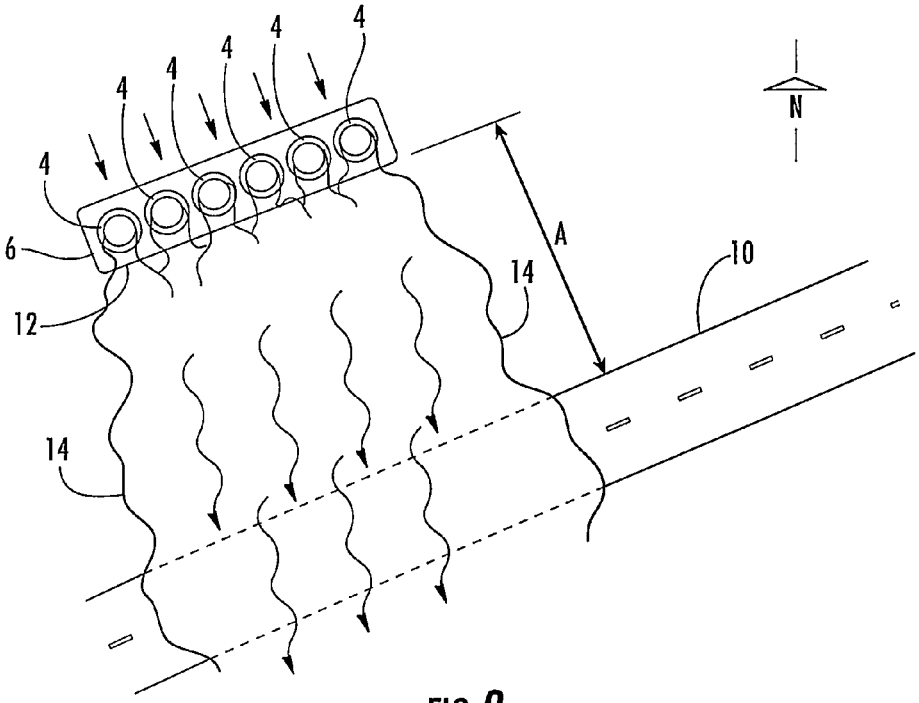
FIG. 2 is a top schematic view showing the current problems and general conditions around an emissions (steam) tower containing facility near a roadway.

For purposes of description herein, the terms "upper," "lower," "right," "left," "rear," "front," "vertical," "horizontal," and derivatives thereof shall relate to the invention. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

The present disclosure is directed to both a system that is installed around an emissions emitting structure 2, such as a factory or utility generating structure, as well as a method that uses the system to prevent emissions 14 from being drawn downward to ground level altitudes (on the leeward side 12 of the emissions emitting structure), but instead assist in raising the emissions, typically into higher altitudes of the atmosphere, thereby reducing or eliminating negative effects on neighboring properties and roadways. This is typically done by creating a volume of air or a zone 16 of increased air pressure where at least two airflows 18, 20 intersect. While a single airflow pair will function to create the increased air pressure volume proximate the leeward side of the emissions emitting structure, a plurality of airflow streams from one or more natural (such as redirected naturally occurring airflow, typically wind) or manmade systems (such as one or more mechanical air moving devices, typically industrial strength fans) may be used to create the increased air pressure volume or zone 16. The increased air pressure volume or zone may be anywhere along and typically proximate the leeward side 12 of the emissions emitting structure(s), more typically within about ½ mile or less of the leeward side 12.

As air currents 8 meet a windward side 24 of the obstacle, typically an emissions emitting structure, an air pressure greater than ambient is created on the windward side 24 of the structure by the compression of the wind against the structure, while on the leeward side 12 of the structure an air eddy of swirling winds is formed in which the air pressure is less than ambient. This lower air pressure on the leeward side of the structure then acts to draw emissions from above the structure down toward itself, after which the emissions are picked up by low altitude winds and carried across neighboring property and roadways. The present system and method remediates this underlying condition thereby preventing any deleterious effects to roadways, property, and people.

According to an embodiment of the present invention, the method and/or system remediates the undesired condition of emissions being drawn downward on the leeward side of a structure by purposely increasing the air pressure on the structure's leeward side 12 to an amount that equals or exceeds that air pressure which exists immediately above the structure. This can be accomplished by a variety of way or combination of ways described herein.

Figure 3:
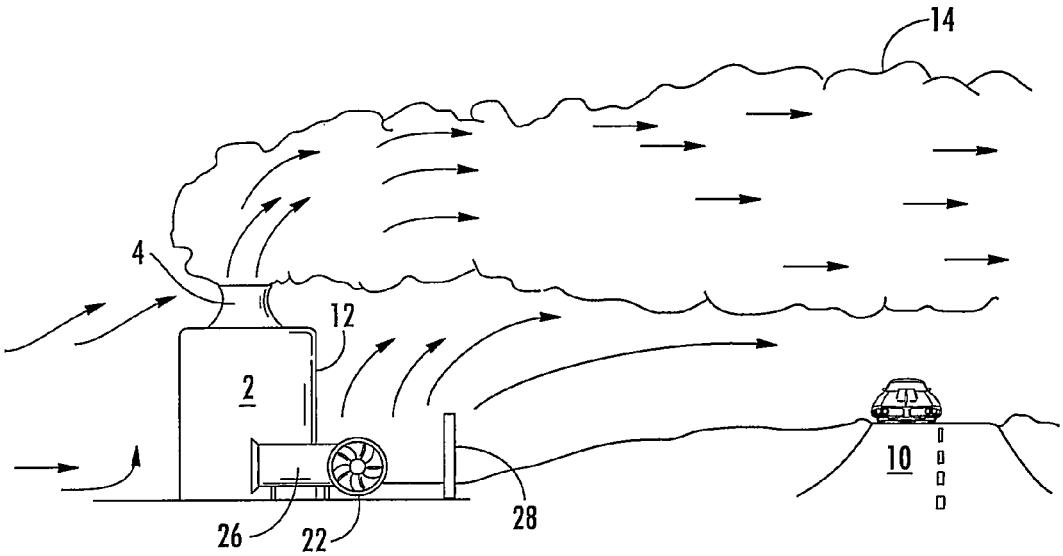
FIG. 3 is a side schematic view of an aspect of the present emissions elevating method/apparatus/system.
Figure 4:
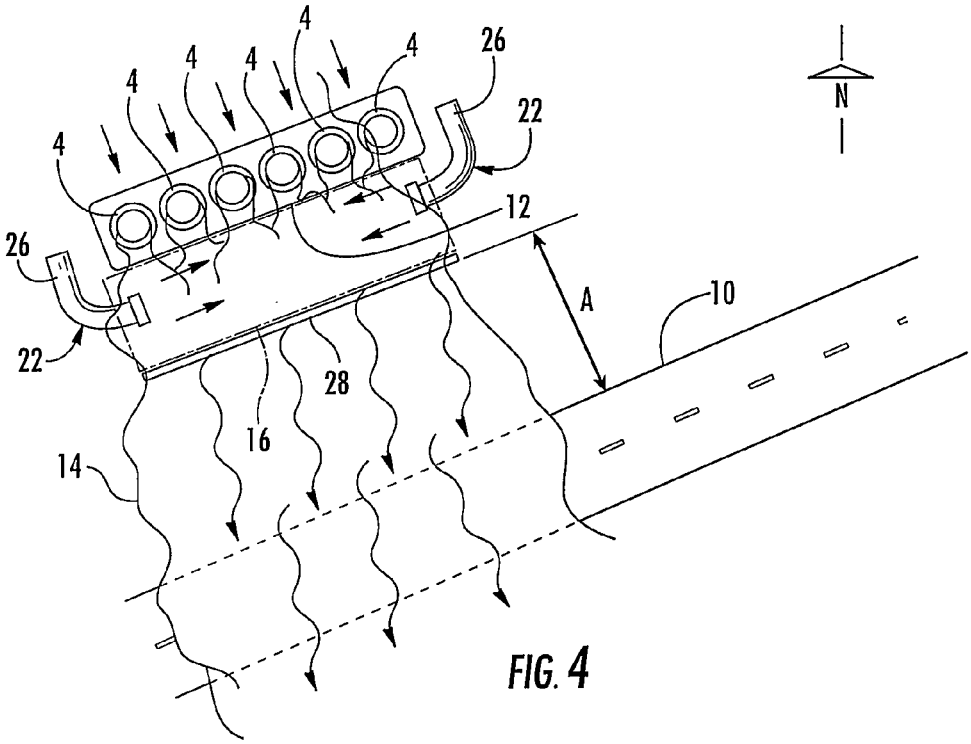
FIG. 4 is a top schematic view of an aspect of the present emissions elevating method/apparatus/system.
Figure 5:
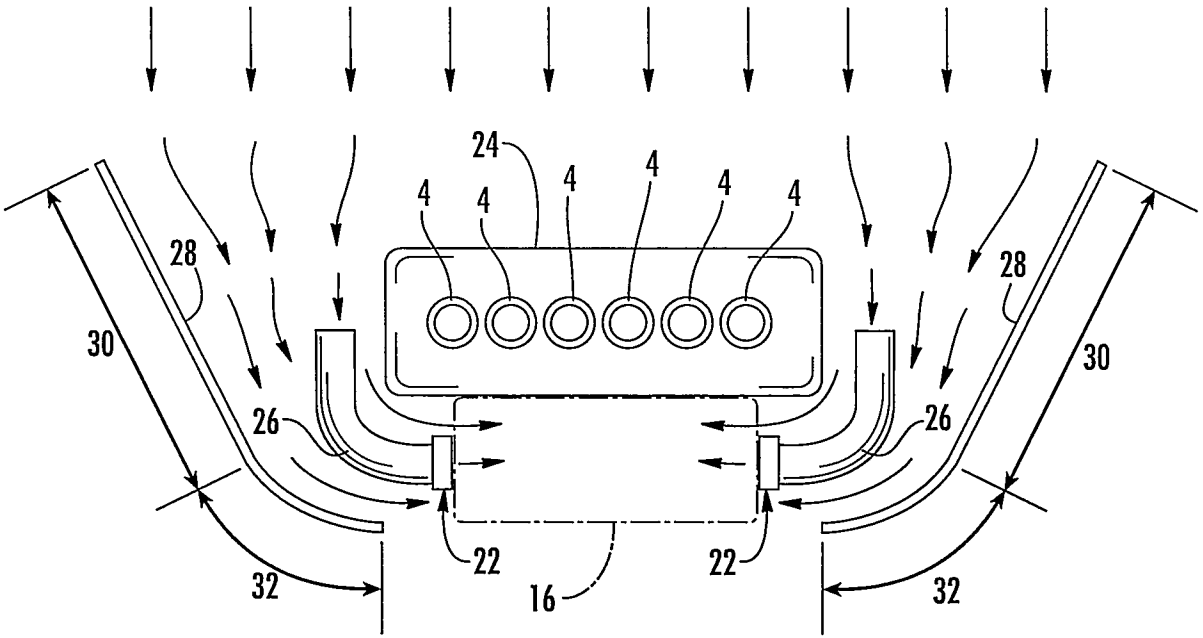
FIG. 5 is a top schematic view of another embodiment of the present disclosure.

As shown in FIGS. 3-5, the increase in air pressure can be achieved by using a system that includes components chosen from one or more of the following: one or more air moving devices; physical structures; and combinations thereof. In one preferred embodiment, the method uses a combination of one or multiple industrial sized fans or other air generating and/or moving devices 22 such as a turbine engine, or other air moving devices near ground level, the exhausts of which shall be directed and/or guided by piping 26 and/or diversion panels 28 in such a manner as to add to the volume and pressure of air on the leeward side 12 of the structure(s) 2. The devices shall be of such volumetric capability as to increase the air pressure on the leeward side of the structure to an amount equal to, or greater than, the air pressure immediately above the structure. A plurality of fans is typically used and is typically positioned at an angle to an exterior leeward wall surface of the emissions emitting structure. The fans are typically positioned at an angle up to 80 degrees from the exterior leeward wall surface of the emissions emitting structure. Emissions are thereby caused to remain at the altitude at which they are emitted, or rise to higher levels, at which they are not considered to be undesirable.

While shown in the attached FIGS. 3-4 as airflow directed at one another, applicant presently believes that the fans may function better if positioned such that the airflow streams from at least two opposing fan generated airflow streams strike one another at an angle to the surface of the emission towers, typically an angle of up to about 80 degrees, more typically from 10-75 degrees, most typically at an angle of between 40-50 degrees from the surface of the leeward side of the emissions emitting structure(s). While facing the airstreams toward one another as in FIGS. 3-4 achieves some benefit, it is believed that positioning the airflow at an angle to one another provides superior and unexpectedly better emissions (steam) removal according to the present invention. Also, if the wind is at an angle to the windward side of the emissions emitting structure, activation of a single fan or airflow generating device or wall may be used to generate the necessary increase in air pressure proximate the leeward surface of the structure.

As shown in FIGS. 3-4, the diversion panels 28, which are typically walls that are ideally braced and/or partially buried underground for added strength, are typically positioned parallel or substantially parallel to the leeward wall of the emissions emitting structure 2 when mechanical air moving devices are used. In addition to the system shown in FIGS. 3-4, diversion walls may be used with or without the air moving devices and vice versa. Typically, if diversion panels or walls are used they are at least about 20% of the height of the tallest exterior wall on the leeward side of the emissions emitting structure, at least about 50% of the height of the tallest exterior wall on the leeward side of the emissions emitting building, but typically 100% or less of the height of the tallest exterior wall on the leeward side of the emissions emitting structure. The panels or walls 28 may be positioned at an angle (see FIG. 5) to the leeward side of the emission emitting structure. When at an angle, at least one pair of panels or walls 28 are typically employed and positioned and configured to redirect wind received from the windward direction into at least two separate airflows that are directed toward one another along the leeward side of the emission emitting structure to form the increased air pressure that prevents or lessens downward flow of emissions. The walls may each include a first portion 30 and a second portion 32 that are at an obtuse angle to one another and ideally curved at their juncture to form a smooth airflow path to maximize the redirection of wind. The first portion is typically longer than the second portion to capture and redirect a greater amount of wind airflow from the windward direction that does not encounter or goes around the sides of the structure.

The lessening of the downward flow of the emissions that would occur without the use of the system prevents the emissions from lessening or blocking the visibility of motorists or other travelers on roads proximate the emissions emitting structure 2. Typically roads as far away as about ½ mile (distance A in the Figures) from the emissions generating building see benefits from the present invention, but more typically the road is about ¼ mile or less and even more typically about 400 feet or less from the leeward side of the emissions emitting structure(s). A plurality of systems or portions of the systems for redirecting or creating airflow streams may be used in the context of the present invention.

The invention claimed is:

1. A method of reducing a downward flow of air currents on the leeward side of an emissions emitting structure comprising the steps of:

using a system that includes components chosen from the group consisting of one or more mechanical air moving devices; physical structures; and combinations thereof which create an increase in an air pressure within a volume of air proximate an exterior leeward wall surface of an emissions emitting structure having emissions that become airborne; wherein the increased air pressure equals or exceeds an air pressure above the structure; and wherein the increased air pressure prevents or lessens downward flow of emissions.

2. The method of claim 1, wherein the system includes a plurality of fans and the fans are positioned at an angle to an exterior leeward wall surface of the emissions emitting structure.

3. The method of claim 2, wherein the fans are positioned at an angle of up to 80 degrees from the exterior leeward wall surface of the emissions emitting structure.

4. The method of claim 1, wherein the emissions comprise steam and wherein the increased air pressure equals or exceeds an air pressure above the structure.

5. The method of claim 1, wherein the physical structures of the system includes at least one vertically oriented wall that is at least about 20% of the height of a tallest exterior wall on the leeward side of the emissions emitting structure.

6. The method of claim 5, wherein the physical structures of the system includes at least one vertically oriented wall that is at least about 50% of the height of a tallest exterior wall on the leeward side of the emissions emitting structure.

7. The method of claim 6, wherein the physical structures of the system includes at least one vertically oriented wall that is at least about 100% of the height of a tallest exterior wall on the leeward side of the emissions emitting structure.

8. The method of claim 1, wherein the mechanical air moving devices of the system uses at least two industrial fans that each generate an airflow stream that are directed such that the airflow streams collide with one another to at least partially create the increased air pressure.

9. The method of claim 8, wherein the physical structures of the system further includes a vertically oriented wall or substantially vertically oriented wall that is positioned parallel or substantially parallel to the leeward side of the emissions emitting structure.

10. The method of claim 1, wherein the emissions comprise: steam, smoke, or combustion emissions.

11. The method of claim 1, wherein the physical structures of the system includes at least two vertically oriented walls or substantially vertically oriented walls that are positioned at an angle to the leeward side of the emission emitting structure and configured to redirect wind received from a windward direction into at least two separate airflows that are directed toward one another along the leeward side of the emission emitting structure to form the increased air pressure that prevents or lessens downward flow of emissions.

12. The method of claim 11, wherein the at least two vertically oriented walls or substantially vertically oriented walls have a first portion and a second portion that are at an obtuse angle to one another.

13. The method of claim 12, wherein the first portion of the at least two vertically oriented walls or substantially vertically oriented walls extends beyond the leeward side of the emission emitting structure and is longer than the second portion.

14. The method of claim 13, wherein the at least two vertically oriented walls or substantially vertically oriented walls are at least about 20% of the height of a tallest exterior face on the leeward side of the emissions emitting structure.

15. A method of reducing a downward flow of air currents on a leeward side of an emissions emitting structure comprising the steps of:

installing components outside and proximate the emissions emitting structure wherein the components are chosen from the group consisting of one or more industrial fans; one or more vertically or substantially vertically oriented walls that are at least 20% of the height of a tallest exterior wall on the leeward side of the emissions emitting structure; and creating an increase in an air pressure within a volume of air proximate and along the tallest exterior wall on the leeward side of an emissions emitting structure using the components wherein the components cause at least two airflows to meet one another and create the increase in the air pressure that reduces the downward flow of air currents on the leeward side of the emissions emitting structure such that the air pressure within a volume of air proximate and along the tallest exterior wall on the leeward side of an emissions emitting structure equals or exceeds the air pressure immediately above the emission emitting structure.

16. The method of claim 15, wherein the components include at least two vertically oriented walls or substantially vertically oriented walls that are positioned at an angle to the leeward side of the emission emitting structure and configured to redirect wind received from the windward direction into at least two separate airflows that are directed toward one another along the leeward side of the emission emitting structure to form the increased air pressure that prevents or lessens downward flow of emissions.

17. The method of claim 15, wherein the emissions emitting structure is a factory or a power plant and wherein the air pressure within a volume of air proximate and along at least a location along the exterior wall on the leeward side of an emissions emitting structure equals or exceeds the air pressure above the emissions emitting structure.

18. A method of reducing a downward flow of air currents on a leeward side of an emissions generating building and preventing emissions from lessening or blocking the visibility of a motorist traveling a road near the building comprising the step of:

creating an increased air pressure zone proximate the leeward side of the building by using at least one airflow creating system that includes components chosen from the group consisting of two or more mechanical air moving devices; physical airflow directing structures; and combinations thereof to create at least two airflows that meet along the leeward side of the emission generating building and increase the air pressure within the zone of air on the leeward side of an emissions generating building chosen from the group consisting of a factory having emissions that become airborne, a power plant having emissions that become airborne, and an industrial or commercial facility having emissions that become airborne; wherein the increased air pressure prevents or lessens downward flow of emissions that would occur without the use of the system and presents the emissions from lessening or blocking the visibility of the motorist traveling the road.

19. The method of claim 18, wherein the system includes at least one vertically oriented wall that is at least about 100% of the height of a tallest exterior wall on the leeward side of the emissions emitting building and the emissions comprise steam or smoke or combustion emissions and the increased air pressure zone is an increased air pressure volume.

20. The method of claim 18, wherein the road is up to about one-half mile away from the emissions generating building and the emissions lessen the visibility of a motorist on the road if the emissions are along the road.

* * * * *